United States Patent [19]

Casuso

[11] Patent Number: 4,870,993

[45] Date of Patent: Oct. 3, 1989

[54] MULTI-GAS VALVES COMPACT SET FOR COOKERS

[76] Inventor: Jose G. Casuso, Francisco Salazar, 14-6Ω Izda., 39004 - Santander, Spain

[21] Appl. No.: 140,870

[22] Filed: Jan. 6, 1988

Related U.S. Application Data

[63] Continuation of Ser. No. 797,135, Nov. 12, 1985, abandoned.

[30] Foreign Application Priority Data

Jun. 27, 1985 [ES] Spain ..... 287.704

[51] Int. Cl.[4] ..... F16K 1/00

[52] U.S. Cl. ..... 137/883; 137/887; 126/39 H; 126/39 N

[58] Field of Search ..... 126/39 N, 39 R, 39 E, 126/41 R; 431/278; 251/205, 208, 209, 148; 137/883, 884, 887

[56] References Cited

U.S. PATENT DOCUMENTS

| | | | |
|---|---|---|---|
| 525,535 | 9/1894 | Conness | 251/148 |
| 908,358 | 12/1908 | Van Dyke | 126/29 H |
| 1,051,180 | 1/1913 | Winger | 126/39 H |
| 1,445,984 | 2/1923 | Wickinson | 126/39 N |
| 1,755,451 | 4/1930 | Morrison | 137/883 |
| 1,775,980 | 9/1930 | Walbridge | 126/39 N |
| 1,950,267 | 3/1934 | Price | 251/148 |
| 2,010,992 | 8/1935 | Howard | 251/148 |
| 2,446,384 | 8/1948 | Murdock | 137/883 |
| 2,450,744 | 10/1948 | Whitehead | 126/39 N |
| 2,506,483 | 5/1950 | Bechtold | 126/39 H |
| 2,524,130 | 10/1950 | Klein | 126/39 N |
| 2,598,961 | 6/1952 | Andus | 137/883 |
| 2,781,779 | 2/1957 | Kindl | 126/39 N |
| 3,459,221 | 8/1969 | Axelrod | 137/883 |
| 3,516,638 | 6/1970 | Piggott | 137/883 |
| 4,269,219 | 5/1981 | Dybvig | 137/322 |

FOREIGN PATENT DOCUMENTS

| | | | |
|---|---|---|---|
| 133593 | 7/1949 | Australia | 126/39 N |
| 895980 | 2/1945 | France . | |
| 465847 | 2/1936 | United Kingdom . | |
| 684960 | 12/1952 | United Kingdom | 126/39 N |
| 726507 | 3/1955 | United Kingdom | 285/370 |
| 1062004 | 3/1967 | United Kingdom | 285/370 |
| 1226645 | 3/1971 | United Kingdom | 137/883 |
| 1538928 | 1/1979 | United Kingdom . | |

*Primary Examiner*—James C. Yeung

*Attorney, Agent, or Firm*—Davis Hoxie Faithfull & Hapgood

[57] ABSTRACT

A compact set for a cooking range comprising a plurality of valves including a single first body containing closing valves situated contiguously and equidistantly.

13 Claims, 3 Drawing Sheets

MULTI-GAS VALVES COMPACT SET FOR COOKERS

This is a continuation of co-pending application Ser. No. 797,135 filed on Nov. 12, 1985 now abandoned.

BACKGROUND OF THE INVENTION

This application for a patent relates to a "MULTIGAS VALVES COMPACT SET FOR COOKERS" bringing into its specific function, essential characteristics of novelty and effectiveness constituting remarkable advantages over those known in this field and existent in the applicable business field.

In order to attain a simplification in manufacturing and the consequent economy of costs, with gains in fuctional performance, an exhaustive investigation has been carried out projecting and making the enunciated set.

In the production of such a set, it is not necessary to mechanize fastening areas or bridles or tube connections, since they are eliminated, avoiding possible leaks. Also the saving of couplings which have been used to avoid leaks in the tap-pipes connections is attained. Also possible breaks and deformation in tap bridles caused by too much tightening are eliminated, therefor discarding the use of the fastening-tube usual screw and bridles. It also entails the gain of a less work in assembling taps, couplings, bridles, tubes, screws, and the subsequent watertightness vertification.

SHORT DESCRIPTION OF THE INVENTION

As an essential element to assure the correct operation of the assembly we are advocating the inclusion of a non-shown thermocouple device.

One gains a greater ease in fastening the elements of the cooker since the main body is provided with areas or holes provided for such purpose.

All of it is also translated into a economy of room allowing a greater availability of room to be used as working table, counting also with the possibility of outlet of the injector element, the conductor tube, the tuyere pipe and other details.

Therefor the multigas valves compact set for cookers being advocated is built based on a single first body attaining through extrusion, casting or stamping, where the bodies of one or more closing valves situated contiguously take place equidistantly.

Such first single body is provided with a longitudinal passage, through which the gas passes to get out through the burners, being provided at the height of each valve with some perpendicular holes ending into the closing valve system, from which the holes to feed such burners continue, being able to make such conduits under right shape or curved shape according to preferences.

For the sake of a better functional effectiveness, gas flow can be regulated rotating closing tap, spherical ball or telescopic slider with O-ring seals or other means has been provided.

The fitting of one or more value units into the single body which protects them, is made by internal sleeves threaded along it's exterior ends and the necessary watertight couplings, thus attaining valve lineal groups in the number wanted of such elements in terms of the provided needs for each cooker.

In each of the valves or through their rod, the inclusion of the fixed minimum injector and controlable has been provided bound to the maintenance of a minimum rate of gas consumption.

With the intention of being able to take one or other end of the inlets of the gas main conduit, one can seal the open end of a terminal valve body, through the use of a an air tight fitting tap, being susceptible therefor of taking for a gas intake the end one wants according to the requirements of the installation.

All the compact assembly being described is easily and safely fastened by the application of screws through some holes provided in the body.

According to the above commentary, there is obvious the lower cost of manufacturing and greater safety as mentioned at the beginning.

DETAILED DESCRIPTION OF THE INVENTION

The following detailed description is referred to the attached figures where as a way of example and without any restricting nature, therefor, since the use may advice any light modification without altering the essentiality of the invention, the materialization that we think suitable has been shown and according to the above commentary.

Figure 1A:
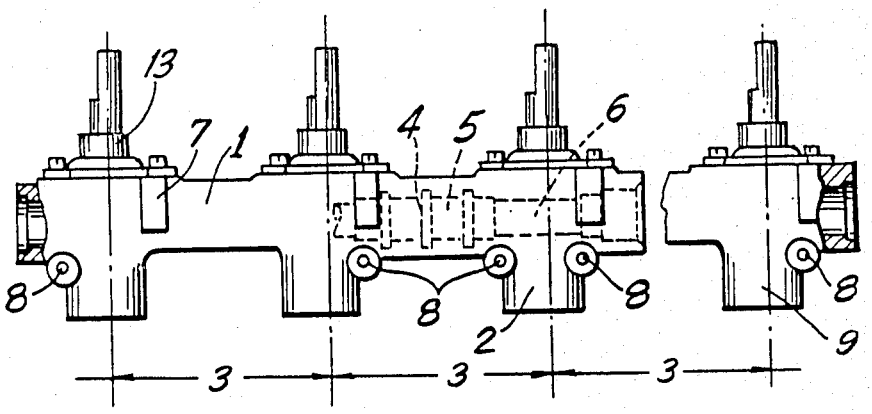
Figure 1B:
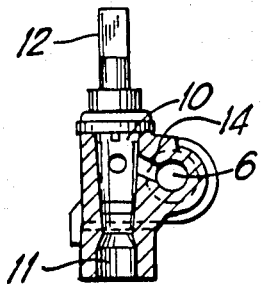
Figure 1C:
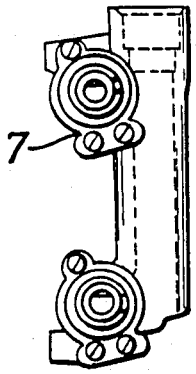
Figure 1D:
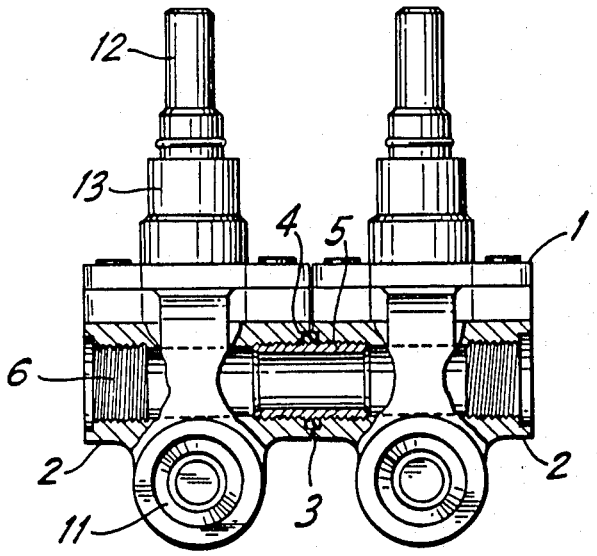
Figure 1E:
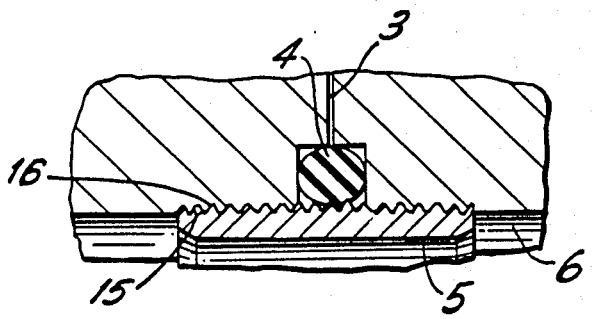
Figure 2A:
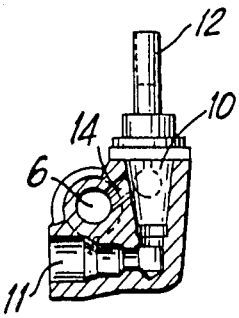
Figure 2B:
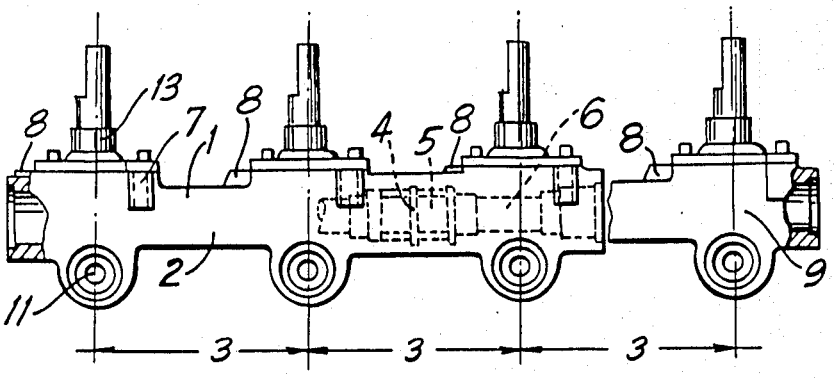
Figure 2C:
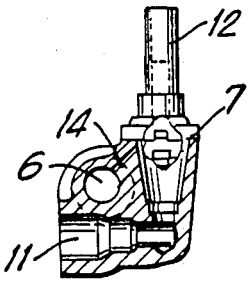
Figure 2D:
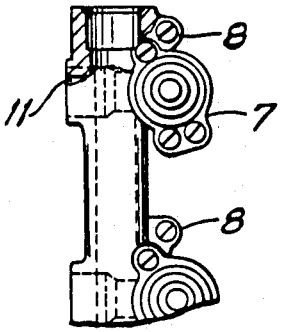
Figure 3:
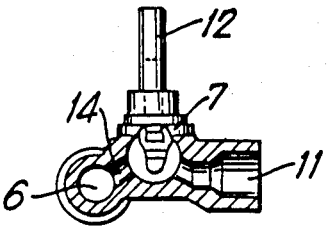

FIG. 1*a* is a front cross sectional view of the compact assembly;

FIG. 1*b* is a side cross sectional view of one valve body;

FIG. 1*c* is a top partial cross sectional view of two contiguous valve bodies;

FIG. 1*d* shows a cross sectional view of two adjacent bodies;

FIG. 1*e* shows a close up cross-section view of part of the threaded sleeve and watertight seal between adjacent bodies;

FIG. 2*a* is a side cross sectional view of another embodiment of the valve body;

FIG. 2*b* is a front cross sectional view of the compact set comprising the valve bodies of FIG. 2*a*;

FIG. 2*c* is another side cross sectional view of the valve body of FIG. 2*a*, showing the injector;

FIG. 2*d* is a top partial cross sectional view of the compact set in FIG. 2*b*, showing contiguous valve bodies; and FIG. 3 is a side cross sectional view of a valve body with a revolving closing spheric ball with a fixed and controllable injector.

According to FIG. 1 body —1— is made up by the joining of two valve units, the body itself of valve —2— that may take part of the end of the valve units, space —3— comprised between each two valve units, equidistant in all the assembly, the watertight O-ring seal —4— that is situated between the threaded sleeves —5— tight sealing the joining between valves, of the compact set, the injectors —7— of fixed and controlable minimum, holes —8— to fasten the set into the cooker, the end —9— of the body of each valvular element, the male part or revolving closing sphere —10— gas pass distributor, gas outlet —11— to the injector, driving rod —1— of the closing male part or the slider of the sphere, and the fitting cap and the safety locking —13—.

The longitudinal passage 6 is threaded along its internal surface 16, at both ends. As shown in FIGS. 1*d* and 1*e* the O-ring seal 4 can be located at the center of the sleeve 5, around its exterior threaded surface 15. To attach contiguous bodies 1 and 2 the internal sleeve 5, having threads 15 along its external surface, is rotated into one end of the longitudinal passage 6. A second body 2 is then rotated onto the exposed end of sleeve 5. Upon tightening, the bodies meet at 3, compressing the O-ring 4 to form an airtight seal. The sleeve is now completely internal to the adjacent bodies, as shown in FIG. 1*d*. The length of the sleeve 5 is such that half of the sleeve lies within the first body and half lies within the second body.

FIG. 2, with similar arrangements of the valves compact set for cookers, includes the same dimensions for similar details or compounding elements.

FIG. 3, with its spheric ball partial section, shows the details of elevations —6—, —7—, —11—, and —12—, with the general conduit and the gas outlet in opposite position, taking in also the idea of spheric ball of the fixed and controlable minimum injector.

I claim:

1. A multi-gas valve compact set for cookers comprising one or more contiguous self-contained bodies, each comprising an outlet to a burner; a means for regulating gas flow; a longitudinal passage extending through said body for allowing gas to flow to said burner and to said other bodies, said longitudinal passage being threaded along the interior surface of each of its ends; a substantially perpendicular passage extending from said longitudinal passage to said means for regulating gas flow; and a passage extending from said means for regulating gas flow to said burner; and an externally threaded sleeve with watertight seals for engaging said threads of said longitudinal passages of two contiguous bodies, said sleeve having a length such that when tightened, said bodies meet, such that about half of said sleeve lies within one body and about half of said sleeve lies within the next body, said threaded sleeve being completely internal to said connected contiguous bodies.

2. A compact set as in claim 1 where said bodies are equidistantly spaced.

3. A compact set as in claim 1 where said body is formed by extrusion, casting or stamping.

4. A compact set as in claim 1 where said longitudinal passage is a transverse pipe extending along the side of said unit.

5. A compact set as in claim 1 where said means for regulating gas flow is chosen from the group consisting of a rotating closing cap, a spherical ball or telescopic slider with O-ring seals.

6. A compact set as in claim 1 where said passage extending to said burner can be curved or at right angles.

7. A compact set as in claim 1 where said longitudinal passage includes a removable closing cap in one or the other end of said passage whereby gas coming into said unit can be carried out from one or another end.

8. A compact set as in claim 1 further comprising a fixed and controllable minimum injector for maintaining a minimum rate of gas consumption.

9. A compact set as in claim 8 wherein said bodies have means for fastening said set to said cooker.

10. A compact set as in claim 9 further comprising a thermocouple.

11. A compact set as in claim 1 where said threaded sleeve with watertight seals comprises an O-ring around the exterior of said sleeve, substantially in the center of said threaded sleeve, such that when one body is connected to an adjacent body, said O-ring is compressed by said bodies engaged by said threaded sleeve.

12. A compact set as in claim 1 where said set includes a removable closing cap for sealing the open end of a terminal body in said set.

13. A multi-gas valve compact set for cookers comprising at least two equidistantly spaced self-contained adjacent bodies, each of said bodies comprising a longitudinal passage extending through the side of each of said bodies, said longitudinal passage having internally threaded ends; a substantially perpendicular passage connecting said longitudinal passage to a means for regulating gas flow to an outlet to a burner, externally threaded sleeves for connecting one body to another by engaging said threads of said longitudinal passages of adjacent bodies, said sleeve having a length such that when a first body is connected to said adjacent body, half of said sleeve lies within said first body and half lies within said adjacent body; substantially watertight seals around said sleeves; a removable closing cap on an open end of a longitudinal passage of a terminal body of said compact, for sealing said open end of said compact, a longitudinal passage of a free end of said other body for connecting to a source of gas; an injector for maintaining a minimum rate of gas consumption; a thermocouple; and a means for fastening said unit to said cooker.

* * * * *